US005363766A

United States Patent [19]

Brandon et al.

[11] Patent Number: 5,363,766

[45] Date of Patent: Nov. 15, 1994

[54] REMJET POWERED, ARMOR PIERCING, HIGH EXPLOSIVE PROJECTILE

[75] Inventors: Fred J. Brandon, Aberdeen; Miles L. Lampson, Havre de Grace, both of Md.; Fred I. Grace, York, Pa.

[73] Assignee: The United States of America as represented by the Secretary of the Army, Washington, D.C.

[21] Appl. No.: 489,932

[22] Filed: Feb. 8, 1990

[51] Int. Cl.[5] ..... F42B 10/34

[52] U.S. Cl. ..... 102/374; 60/270.1; 102/473; 102/476

[58] Field of Search ..... 60/270.1; 102/374, 376, 102/476, 489, 503, 473; 244/3.1, 3.22

[56] References Cited

U.S. PATENT DOCUMENTS

| | | | |
|---|---|---|---|
| 2,503,271 | 4/1950 | Hickman | 102/374 |
| 2,684,570 | 7/1954 | Nordfors | 60/270.1 |
| 3,439,613 | 4/1969 | Thomanek | 102/476 |
| 3,903,802 | 9/1975 | Squiers | 102/38 |
| 4,428,293 | 1/1984 | Botwin et al. | 102/381 |
| 4,502,649 | 3/1985 | Botwin et al. | 244/3.1 |
| 4,539,911 | 9/1985 | Flatau | 102/374 |
| 4,573,648 | 3/1986 | Morenus et al. | 102/503 |
| 4,645,139 | 2/1987 | Guillot et al. | 102/476 |
| 4,796,534 | 1/1989 | Mikhail | 102/374 |
| 4,944,226 | 7/1990 | Wedertz et al. | 102/476 |

FOREIGN PATENT DOCUMENTS

| | | | |
|---|---|---|---|
| 3800975 | 7/1989 | Germany | 102/476 |

*Primary Examiner*—Harold J. Tudor
*Attorney, Agent, or Firm*—Saul Elbaum; Paul Clohan; Walter R. Baylor

[57] ABSTRACT

An armor piercing projectile having a ramjet engine located at the forward end such that the exhaust nozzles of the ramjet engine are located at or near the center of gravity of the projectile. A warhead is contained in the center portion of the projectile and is either a shaped charge device or a high explosive warhead. A tail boom with stabilizing fins is located at the rear of the projectile. In an alternate embodiment, the ramjet engine is attached by an extension sleeve to the warhead allowing it to telescope after launch and provide increased standoff for better penetration by the shaped charge. Another embodiment allows the ramjet motor to detach prior to impact at the target to better allow the warhead to penetrate. A further embodiment incorporates an armor piercing subprojectile located within the centerbody of the ramjet motor.

8 Claims, 4 Drawing Sheets

REMJET POWERED, ARMOR PIERCING, HIGH EXPLOSIVE PROJECTILE

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention:

The present invention relates to a gun-launched ramjet projectile, and more particularly, to a ramjet projectile with improved stability, increased probability of hitting a target and increased terminal effectiveness at the target.

2. Description of the Prior Art:

Ramjet propulsion devices are known generally. Characteristics of ramjets have been utilized in numerous prior art devices. In general, a ramjet is a type of engine which utilizes the velocity of the device through the atmosphere to compress air within a combustion chamber. The air then mixes with a fuel, either solid or liquid, within a combustion chamber. As the incoming air is compressed, its temperature is raised sufficiently high to initially combust the fuel which continues to burn due to the movement of air through the device. A suitably sized and shaped nozzle is provided at the rear of the combustion chamber and the heated air and products of the combustion pass through the nozzle forming a stream of high velocity gases. The thrust imparted to the projectile is thus the result of the high velocity gases which are exhausted from the nozzle at the rear of the projectile.

One application of a ramjet powered projectile would be for tank-fired, high-explosive, anti-armor munitions. Conventional, unguided, high-explosive, anti-tank (HEAT) projectiles are unpowered after leaving the cannon barrel. One reason is that if a rear-mounted propulsion system (such as a pusher rocket) is used on such a projectile, the thrust is applied relatively far from the projectile's center of gravity and so large turning moments can be generated by small fluctuations in the thrust. These turning moments tend to deflect the projectile off course. The effect of thrust and other asymmetries can be reduced by rolling the projectile so that the deflections are averaged out. However, high spin rates are detrimental to the operation of shaped-charged warheads contained in the projectile and to the combustion process performance of the ramjet engine. For these reasons, unguided HEAT shells fired from tanks are generally unpowered and launched at high velocity but decelerate fairly rapidly in flight. The result is a long time-of-flight to distant targets. In the time elapsed between launch and impact, the target may move or the shell may drift off-target in a cross wind.

A conventional HEAT projectile has a structure designed primarily to withstand the stresses it experiences at launch and is fuzed to explode nearly instantaneously on contacting the target. The bodies of such shells have little potential for armor-piercing because of their light construction. Such shells generally rely on shaped-charge jets to penetrate armor; as a consequence, light weight armors composed of spaced thin plates can defeat conventional HEAT projectiles which explode on the outer surface of the armor outer armor plate and the vehicle's skin.

The present invention locates the exhaust nozzle of the ramjet engine near the center of gravity of the projectile thus variations in thrust have a very small moment arm to deflect the projectile off course. This also allows the spin rate of the projectile to be greatly reduced with no decrease in projectile stability.

OBJECTS AND SUMMARY OF THE INVENTION

It is therefore a primary object of the invention to provide a projectile that can either sustain its initial launch velocity, accelerate from its initial launch velocity, or decelerate downrange at a much reduced rate compared to that of an unpowered projectile.

A second object of this invention is to provide a projectile with the ramjet motor located in the forward section of the projectile to enhance its aerodynamic stability since the thrust is applied near the center of gravity of the projectile thus reducing the effect of off center thrust and increasing the probability of hitting the target.

A still further object of the present invention is to reduce the spin rate necessary on a gun launched projectile. This will result in less stress on the imbeded warhead and improve the combustion performance of the ramjet engine.

Another object of the invention is to improve the lethality of HEAT projectiles by reducing the time-of-flight to the target thus increasing the probability of hitting the target at long ranges. Lethality will also be improved by using the motor of the ramjet as a battering ram to punch through thin armor plate thus increasing the lethality of the shaped-charge warhead.

These and other objects are achieved by designing a ramjet powered projectile with the engine located at the front of the projectile, with the exhaust nozzles at or very near the center of gravity of the projectile. The ramjet engine is supported by struts attached to the main body of the projectile in which the warhead is located. The ramjet fuel is stored on both the engine cowling and the engine centerbody to increase the fuel burning surface which allows for a shorter motor. A fuze is located in the base of the warhead to sense the projectile's deceleration and detonate the warhead immediately or after a time delay. A tail boom on the projectile carries the stabilizing fins which are generally smaller because the lateral components of the deflected ramjet exhaust supply some stability.

DETAILED DESCRIPTION OF THE PREFERRED EMBODIMENTS

Figure 1A:
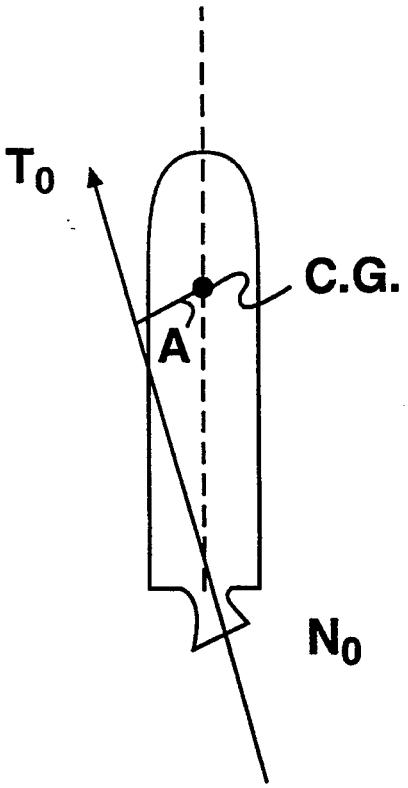
FIG. 1*a* is illustrative of motor placement in the prior art.
Figure 1B:
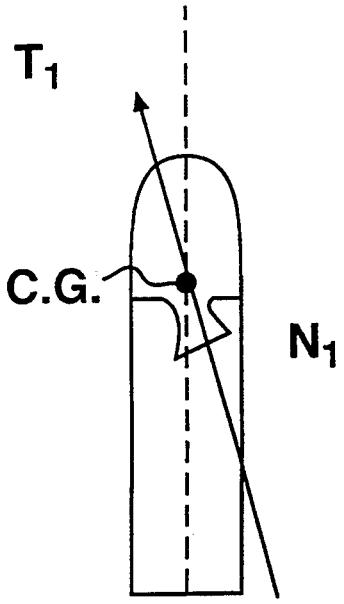
FIG. 1*b* is illustrative of motor placement in the present invention.

The action of a ramjet engine in prior art is illustrated in FIG. 1*a*. Shown is a typical rear-mounted or pusher propulsion system. For aerodynamical stability, the center of gravity (C.G.) of the projectile must be near the front of the projectile. The exhaust nozzle $N_o$ is shown inclined with respect to the missile axis; the result is a linear and angular misalignment of the thrust $T_o$. The moment arm of the thrust vector is "A" and thus the turning moment is $T_oA$. FIG. 1*b* illustrates the propulsion system of the present invention which does not have the exhaust nozzles located at the rear of the projectile. In the present invention, a plurality of annular exhaust nozzles are located on the projectile at about the center of gravity. One of the nozzles ($N_1$) is shown inclined with respect to the missile axis, thus thrust $T_1$ has virtually no moment arm to cause the projectile to veer off course. The turning moment is thus $$\sum_{i}^{N} T_i \epsilon_i$$

(a sum over all N nozzles); however the moment arms $\epsilon_i$ are so small that the thrust fluctuations have a very small effect compared to a rear-mounted pusher system.

Figure 2:
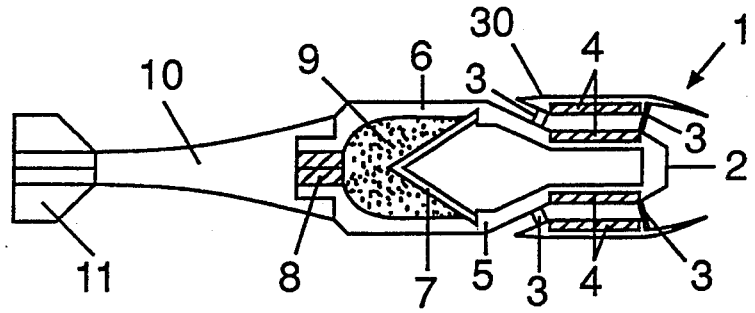
FIG. 2 is a cross section of one embodiment of the present invention.

A ramjet-powered HEAT shell according to the present invention is shown in FIG. 2. An aerodynamic ramjet motor 1 is supported on an armor-piercing centerbody 2 by struts 3. The ramjet fuel 4 is stored both on cowling 30 and on centerbody 2 to increase the fuel burning surface and to allow for a shorter motor. In this embodiment armor-piercing centerbody 2 and armor piercing nose 5 are integrated into the motor design. The wall thickness of projectile body 6 is greater than that of a conventional HEAT shell which allows it to support the armor-piercing nose 5 and centerbody 2 in attacks against very light armor. Shaped-charge liner 7 is more robust than in a conventional HEAT shell to harden it against the deceleration suffered by the projectile upon impacting light armor. Fuze 8 in the base of the projectile senses the projectiles deceleration and either detonates explosive 9 immediately or allows for a small time delay. Tail boom 10 carries stabilizing fins 11 which can be made smaller for this type of projectile because the lateral components of the ramjet exhaust supply some stability.

Figure 3:
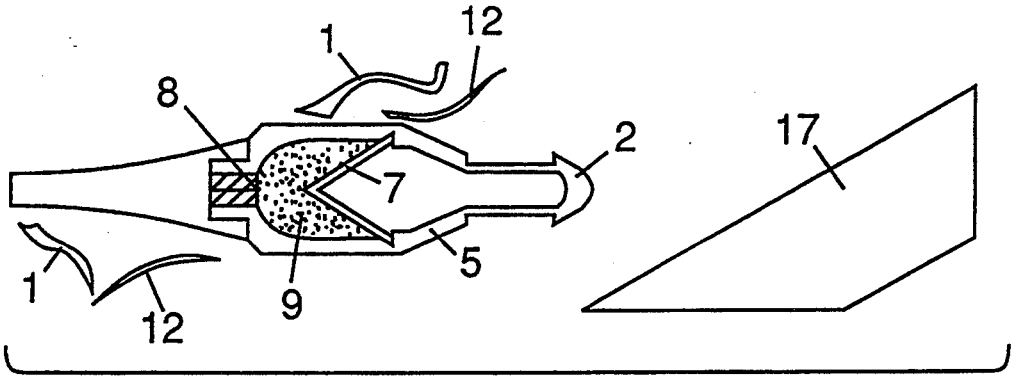
FIG. 3 illustrates the present invention attacking an armored vehicle.
Figure 4:
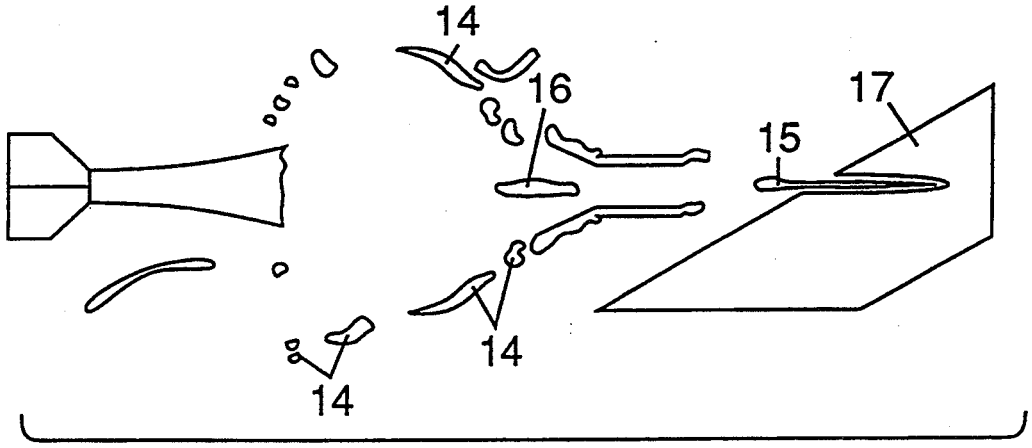
FIG. 4 illustrates the warhead action against a vehicles hull armor.

Impact of this armor-piercing, ramjet-powered HEAT shell is illustrated in FIG's. 3 and 4. As shown in FIG. 3, upon hitting the vehicle's lightweight skirting plate 12 (which would have caused a conventional HEAT shell to detonate), the ramjet motor's cowling 1 is stripped away. Fuze 8 senses an acceptably weak deceleration and delays the initiation of explosive 9 until centerbody 2 and nose 5 open a hole in the vehicle's skirting plate 12 and the projectile passes through. In FIG. 4, shaped charge 9 explodes throwing projectile body fragments 14 outward. The collapsing of shaped-charge liner 7 produces a high-speed jet penetrator 15 and a lower speed slug 16. Jet 15 then penetrates hull armor 17 from a more advantageous standoff distance.

Figure 5:
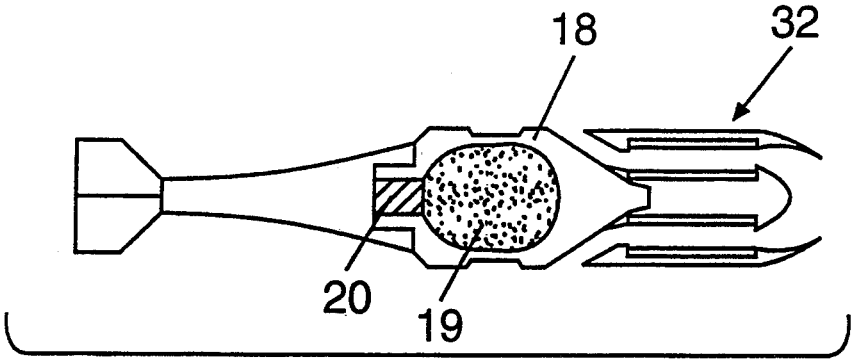
FIG. 5 is a cross section of an alternate embodiment of the present invention.

A robust high explosive projectile can also be made according to the teachings of the present invention with the capability to penetrate light armor (up to one-third caliber thickness) and also the walls of buildings and bunkers. Such a shell is shown in FIG. 5. Motor 32 not only propells the projectile downrange, but also helps to cushion the shock at impact, lessening the initial damage to the armor-piercing head 18 of the projectile, located near the middle of the projectile. Such a projectile, with a sufficiently impact insensitive explosive 19 will survive this type of impact. A built-in time delay fuze 20 will then cause explosive 19 to explode inside the structure attacked. Fuze 20 could also have sensors in the body of the projectile to detonate explosive 19 prior to full penetration if the projectile were in danger of breaking up.

Figure 6A:
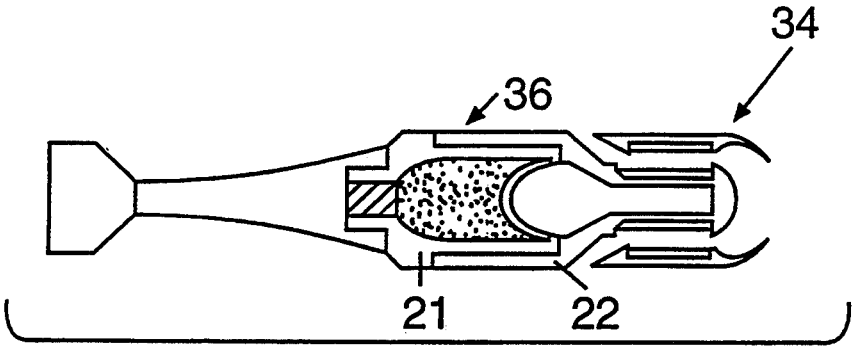
FIG. 6*a* is a cross section of an alternate embodiment of the present invention.
Figure 6B:
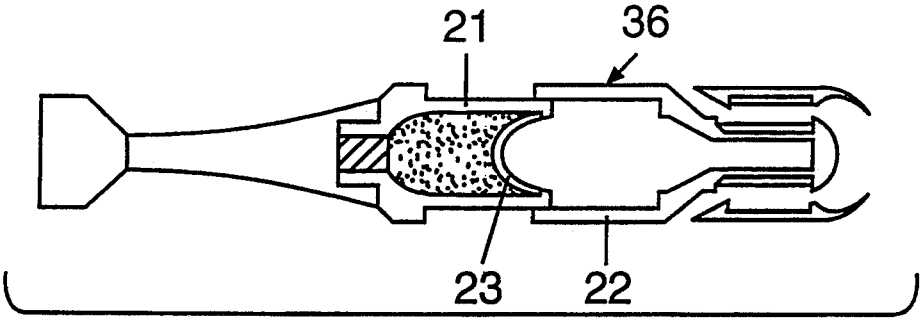
FIG. 6*b* is a cross section of an alternate embodiment of the present invention.

Because it is desirable to have 2 to 5 liner diameters of "standoff" before the jet begins to penetrate the target, the ramjet powered HEAT shell shown in FIG. 6*a* has a telescoping body 36. After the projectile is launched, shell wall 21 unlatches and motor 34 pulls out extension sleeve 22. The projectile has now telescoped as shown in FIG. 6*b*. Although this type of shell has virtually no armor-piercing capability, the increased standoff from the target when the shell detonates, with no time delay, is beneficial. The increase in standoff length, from 1.8 to 3.1 liner diameters, allows different kinds of shaped-charge liners 23 to be employed thus increasing the lethality of the projectile against the target.

Another embodiment of the ramjet-powered HEAT shell is illustrated in FIG's. 7*a* and 7*b*. The projectile now contains a long-standoff fuze 24 and fuze sensors 38 which sense the target some distance ahead of the projectile. At the proper time, motor 25 detaches (shown in FIG. 7*b*) from the rest of the shell, carrying a heavy armor-piercing ballistic ogive 26 which predamages the target. The warhead then proceeds to attack the target as described previously.

Figure 8:
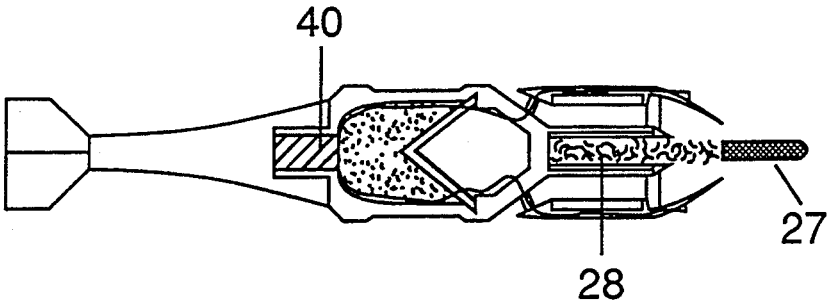
FIG. 8 is a cross section of an alternate embodiment of the present invention.

A still further embodiment of the present invention is illustrated in FIG. 8. A long-standoff fuze 40 detects the target in time to launch an armor-piercing subprojectile 27 from projector 28 in the nose of the shell. Subprojectile 27 predamages the target. The warhead then proceeds to attack the target in the manner previously described.

The power required to propel the projectile downrange can be estimated from the following equation. For the case of a constant drag coefficient, $C_D$, the drag force, $F_D$, is $$F_D = m_p \frac{dv}{dt} = -\alpha v^2 \tag{1}$$

where $m_p$ is the mass of the projectile, v is its instantaneous velocity, t is the elapsed time from launch, and $\alpha$ is a proportionality constant, $$\alpha = \tfrac{1}{2}\beta_a C_D A_p \tag{2}$$

where $\beta_a$ is the mass density of the air through which the projectile is passing, and $A_p$ is the presented area of the projectile. If the projectile is unpowered, the solution to equation (1) is:

$$v(t) = \frac{m_p v_o}{m_p + \alpha v_o t} \tag{3}$$

where $V_o$ is the initial (launch) velocity of the projectile. For a powered projectile, under the assumption of constant thrust and constant drag coefficient, Equation (1) becomes:

$$F = F_T - F_D = m_p \frac{dv}{dt} \tag{4}$$

where F is the net force acting on the projectile and $F_T$ is the thrust force. If the thrust force just balances the drag force there will be no deceleration (or acceleration) of the projectile. For example, let:

$V_o = 1200 m/s$ $\beta_a = 1.21 kg/m^3$ $A_p = 0.0113 m^2$

For a ramjet at this speed, $C_D = 0.25$ and so $\alpha = 0.00171$ kg/m. The drag force is $F_D = -\alpha V^2 = -2460N$. For a ramjet, thrusting at an angle Θ with respect to the projectile axis, the drag-opposing thrust component is $F_T \cos \Theta$. Thus, the thrust required is:

$$F_T = \frac{-F_D}{\cos\Theta} \tag{5}$$

For $\Theta = 30°$, $F_T = 2840N$. Thrust levels of approximately 330N are common from conventional solid fuel ramjets of 120 mm diameter, so adequate thrust is available.

Figure 7A:
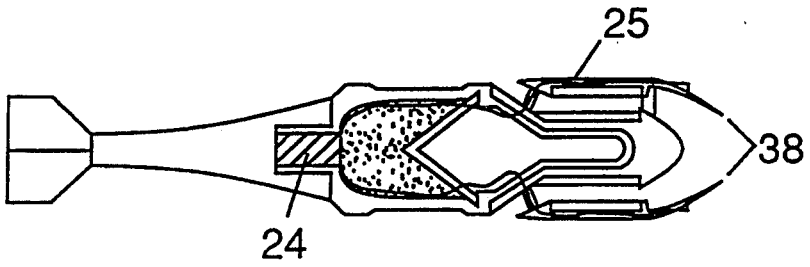
FIG. 7*a* is a cross section of an alternate embodiment of the present invention.
Figure 7B:
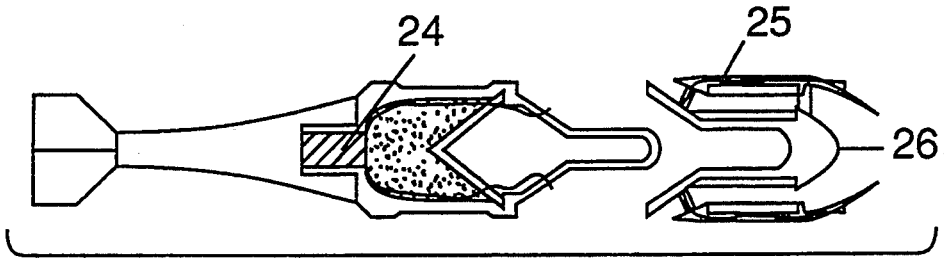
FIG. 7*b* is a cross section of an alternate embodiment of the present invention.

Consider the configuration of FIG. 7 in which the motor detaches from the projectile body. The drag coefficient of the separated body is probably about that of the conventional spike-nosed HEAT projectile, about 0.5 at this velocity. The drag coefficient of the motor might decrease slightly, say to about 0.20. Then:

$F_D(projectile) = -4920N$ $F_D(motor) = -1968N$ $F_T(projectile) = 0N$ $F_T \cos 0(motor) = 2460N$ so the projectile will begin to slow down according to Equation (3) and the motor will begin to accelerate to a new equilibrium speed at which the thrust equals the drag.

For the projectile, $m_p = 13$ kg, $$v_p(t) = \frac{1200}{1 + 0.32t} \ (m/s)$$

so $$\frac{dv_p}{dt} = \frac{-384 \ m/s^2}{(1 + 0.32t)^2}$$

At small times $$t \cong 0 \text{ so } \frac{dv_p}{dt} \cong -384 \ m/s^2$$

For the motor, $$F_T - F_D = m_m \frac{dv_m}{dt} \tag{6}$$

where $m_m$ is the mass of the motor. Suppose $m_m = 3$ kg, then:

$$2460N - 1968N = 3 \text{ kg} \frac{dv_m}{dt} + 164 \ m/s^2 = \frac{dv_m}{dt}$$

The separation between the tail of the motor and the tip of the projectile is approximately:

$$s = \left(\overline{v_m} - \overline{v_p}\right) t_f \tag{7}$$

where $\overline{v_m}$ is the average velocity of the motor and $V_p$ is the average velocity of the projectile over the time period $t_f$ from unlatching the motor to impact of the tip of the motor on the target. There will be some transition time period (which is not included) during the separation until the drag coefficients are stabilized at the new values. Nevertheless, to obtain a separation of about a meter between rear of motor and nose of projectile requires about 60 milliseconds. This suggests that the target must be identified at a range of about 75 meters.

The projector indicated in FIG. 8 is a short, lightweight, low-pressure launcher which fires a small subprojectile at a velocity only slightly above that of the projectile. Let v be the velocity of the parent projectile after launching the subprojectile and $v^1$ be the average velocity of the subprojectile after launch. Let s be the desired separation between the tail of the subprojectile and the tip of the parent projectile so that, as before, $$s = (v^1 - v) t_f$$

Let the time to accelerate the subprojectile to its muzzle velocity be $t_a$. If the decision to shoot the subprojectile coincides with the time of target detection, the range of detection is:

$$R = vt_a + vt_f + s$$

For typical values of v, $t_a$, $t_f$, and s of 1200 m/s, 2 milliseconds, 8 milliseconds, and 1.2 meters, respectively, so R = 13 meters (approx) if $v^1 = 1350$ m/s.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A ramjet propelled projectile comprising:

a generally cylindrical warhead located at the center of said projectile;

a ramjet motor located at the forward end of said projectile, said ramjet motor comprising a cowling, a centerbody, a plurality of struts, a fuel, an intake nozzle and a plurality of exhaust nozzles;

said plurality of exhaust nozzles located at or near the center of gravity of said projectile;

said fuel located on an interior surface of said cowling and on an exterior surface of said centerbody;

a fuze located at the rear end of said warhead;

a tail boom attached to the rear of said warhead, said tail boom having a plurality of stabilizing fins.

2. The device of claim 1 wherein said warhead comprises a shaped explosive charge, a shaped charge liner, and an armor piercing nose.

3. The device of claim 1 wherein said warhead comprises a high explosive warhead.

4. The device of claim 1 wherein said ramjet motor is slideably attached to said warhead by an extension sleeve so as to form a telescoping body after launch of said projectile.

5. A ramjet propelled projectile comprising:

a generally cylindrical warhead located at the center of said projectile;

a ramjet motor removeably attached and located at the forward end of said projectile, said ramjet motor comprising a cowling, an armor piercing or give, a plurality of struts, a fuel, an intake nozzle and a plurality of exhaust nozzles;

said plurality of exhaust nozzles located at or near the center of gravity of said projectile;

said fuel located on an interior surface of said cowling and on an exterior surface of said centerbody;

a long standoff fuze located at the rear end of said warhead;

fuze sensors located at the forward end of said projectile;

a tail boom attached to the rear of said warhead, said tail boom having a plurality of stabilizing fins.

6. The device of claim 5 wherein said motor detaches from said projectile prior to said projectile hitting a target.

7. A ramjet propelled projectile comprising:

a generally cylindrical warhead located at the center of said projectile;

a ramjet motor located at the forward end of said projectile, said ramjet motor comprising a cowling, a centerbody, a plurality of struts, a fuel, an intake nozzle and a plurality of exhaust nozzles;

said plurality of exhaust nozzles located at or near the center of gravity of said projectile;

said fuel located on an interior surface of said cowling and on an exterior surface of said centerbody;

an armor piercing subprojectile located within said centerbody;

a fuze located at the rear end of said warhead;

a tail boom attached to the rear of said warhead, said tail boom having a plurality of stabilizing fins.

8. The device of claim 7 wherein said armor piercing subprojectile is launched from said centerbody in time to predamage a target.

* * * * *